US011397411B2

(12) United States Patent
Nagareda

(10) Patent No.: US 11,397,411 B2
(45) Date of Patent: Jul. 26, 2022

(54) ELECTRONIC TIMEPIECE, PROCESSING SELECTION METHOD, AND STORAGE MEDIUM

(71) Applicant: CASIO COMPUTER CO., LTD., Tokyo (JP)

(72) Inventor: Hirofumi Nagareda, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 346 days.

(21) Appl. No.: 16/120,501

(22) Filed: Sep. 4, 2018

(65) Prior Publication Data

US 2019/0072914 A1 Mar. 7, 2019

(30) Foreign Application Priority Data

Sep. 4, 2017 (JP) ..... JP2017-169485

(51) Int. Cl.

| | |
|---|---|
| ***G04G 21/04*** | (2013.01) |
| ***G04R 20/26*** | (2013.01) |
| ***G04G 7/00*** | (2006.01) |
| ***G04R 20/00*** | (2013.01) |
| ***G04R 20/20*** | (2013.01) |

(52) U.S. Cl.

CPC ..... *G04R 20/26* (2013.01); *G04G 7/02* (2013.01); *G04G 21/04* (2013.01); *G04R 20/00* (2013.01); *G04R 20/20* (2013.01)

(58) Field of Classification Search

CPC ..... G04R 20/26; G04R 20/20; G04R 20/00; G04G 7/02; G04G 21/04

See application file for complete search history.

(56) References Cited

U.S. PATENT DOCUMENTS 9,483,029 B2 * 11/2016 Iida ..... G04R 20/04
9,720,382 B2 * 8/2017 Nakanishi ..... G04B 19/223

(Continued)

FOREIGN PATENT DOCUMENTS

JP 2000-136941 A 5/2000
JP 2006-337380 A 12/2006

(Continued)

OTHER PUBLICATIONS

Extended European Search Report dated Feb. 1, 2019 received in European Patent Application No. EP 18191395.5.

(Continued)

*Primary Examiner* — Sean Kayes

(74) *Attorney, Agent, or Firm* — Scully Scott Murphy & Presser

(57) ABSTRACT

An electronic timepiece includes a timer that clocks a current time, a receiver that receives radio waves, a switch that receives an operation from a user, and a processor. The processor acquires, in accordance with the operation received by the switch, a determination result indicating whether the radio waves are receivable by the receiver, and selects and executes one of a first processing and at least one second processing that differs from the first processing. The first processing is processing to correct the current time clocked by the timer on the basis of the radio waves received by the receiver. The processor does not select the first processing when the determination results indicate that the radio waves are not receivable by the receiver.

6 Claims, 6 Drawing Sheets

(56) References Cited

U.S. PATENT DOCUMENTS

| | | | | |
|---|---|---|---|---|
| 9,720,384 | B2 * | 8/2017 | Honda | G04R 20/04 |
| 2005/0157592 | A1 | 7/2005 | Nakamura | |
| 2013/0110264 | A1 * | 5/2013 | Weast | G16H 40/63 700/91 |
| 2015/0103871 | A1 | 4/2015 | Akiyama et al. | |
| 2015/0146503 | A1 * | 5/2015 | Nakanishi | G04G 9/0076 368/21 |
| 2015/0277387 | A1 | 10/2015 | Hasegawa | |
| 2015/0311933 | A1 * | 10/2015 | Honda | G04R 20/04 455/140 |
| 2017/0146960 | A1 | 5/2017 | Fujisawa | |
| 2017/0357222 | A1 * | 12/2017 | Araki | G04G 5/00 |
| 2018/0004169 | A1 * | 1/2018 | Matsuzaki | G06F 1/1658 |

FOREIGN PATENT DOCUMENTS

| | | | |
|---|---|---|---|
| JP | 2007-333429 | A | 12/2007 |
| JP | 2017-003304 | A | 1/2017 |
| WO | WO 2005/031475 | A1 | 12/2006 |

OTHER PUBLICATIONS

Notice of Reasons for Refusal dated Jun. 29, 2021 received in Japanese Patent Application No. JP 2017-169485 together with an English language translation.

* cited by examiner

ELECTRONIC TIMEPIECE, PROCESSING SELECTION METHOD, AND STORAGE MEDIUM

CROSS-REFERENCE TO RELATED APPLICATION

This application claims the benefit of Japanese Patent Application No. 2017-169485, filed on Sep. 4, 2017, the entire disclosure of which is incorporated by reference herein.

FIELD

This application relates generally to an electronic timepiece, a processing selection method, and a storage medium.

BACKGROUND

In the related art, there are electronic timepieces that have functions to receive standard radio waves from radio towers and automatically correct the time on the basis of time information indicated by the received radio waves (for example, see Unexamined Japanese Patent Application Kokai Publication No. 2006-337380).

However, time correction based on the reception of standard radio waves, such as that disclosed in Unexamined Japanese Patent Application Kokai Publication No. 2006-337380, can only be carried out in areas where standard radio waves can be received. Accordingly, in an electronic timepiece having various executable functions including time correction based on standard radio waves, a user may be inconvenienced if, when selecting a function to be executed from among the various functions, it is possible to select time correction based on the reception of standard radio waves regardless of being in an area where standard radio waves cannot be received.

An object of the present disclosure is to provide an electronic timepiece capable of improving operability, a processing selection method, and a program.

SUMMARY

An electronic timepiece according to one aspect of the present disclosure includes a timer that clocks a current time, a receiver that receives radio waves, a switch that receives an operation from a user; and a processor. The processor acquires, in accordance with the operation received by the switch, a determination result indicating whether the radio waves are receivable by the receiver, and selects and executes one of a first processing and at least one second processing that differs from the first processing. The first processing is processing to correct the current time clocked by the timer on the basis of the radio waves received by the receiver. The processor does not select the first processing when the determination result indicates that the radio waves are not receivable by the receiver.

BRIEF DESCRIPTION OF THE DRAWINGS

A more complete understanding of this application can be obtained when the following detailed description is considered in conjunction with the following drawings, in which.

DETAILED DESCRIPTION

Hereinafter, embodiments are described while referencing the drawings.

Embodiment 1

Figure 1:
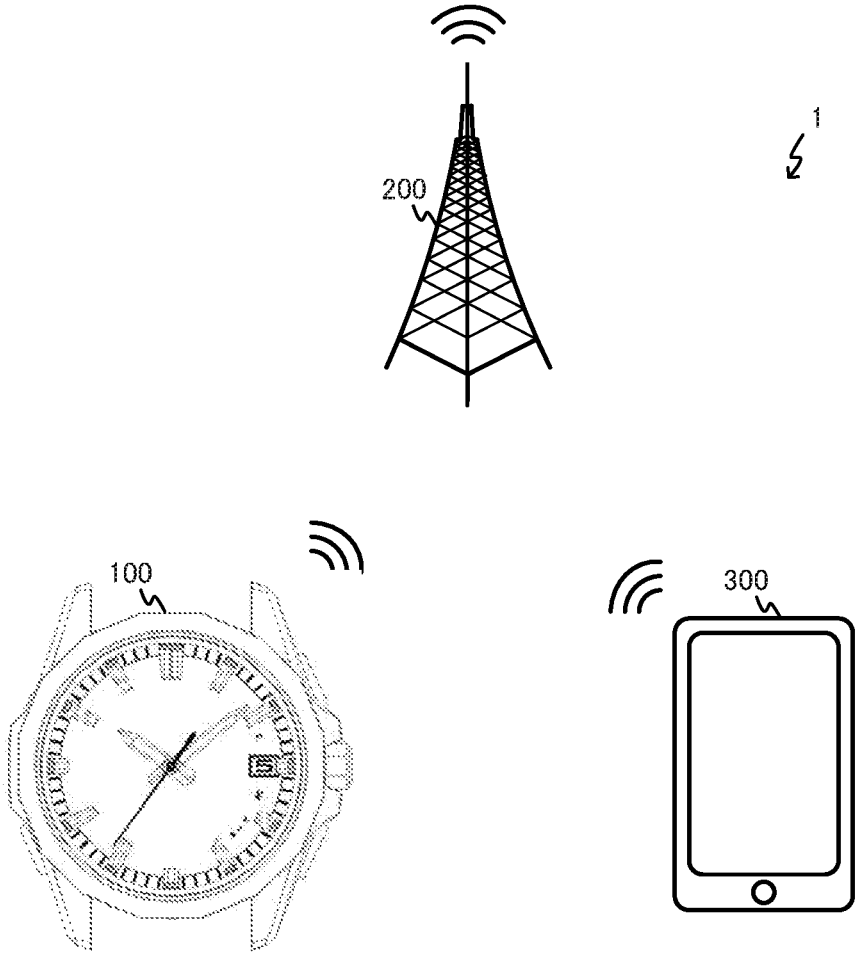
FIG. 1 is a drawing illustrating a configuration example of a wireless communication system according to Embodiment 1.

FIG. 1 is a drawing illustrating a configuration example of a wireless communication system 1 according to Embodiment 1. The wireless communication system 1 includes an electronic timepiece 100, a radio tower 200, and a wireless communication device 300. As described later, the electronic timepiece 100 is capable of selecting and executing one of processing to correct the time by low frequency band standard radio waves (hereinafter referred to as "standard radio waves") used in time adjustment and received from the radio tower 200, and processing to correct the time by wirelessly communicating with the wireless communication device 300 via Bluetooth (registered trademark) Low Energy (hereinafter referred to as "BLE"). In the near-field communication protocol called Bluetooth (registered trademark), BLE is a protocol (mode) designed to achieve low power consumption. The radio tower 200 is a standard radio wave radio station that transmits time information indicating the date and the time. The wireless communication device 300 is an electronic device provided with wireless communication functions, such as a smartphone, a mobile phone, a personal computer (PC), or a personal digital assistant (PDA).

Next, the configuration of the electronic timepiece 100 according to Embodiment 1 will be described.

Figure 2:
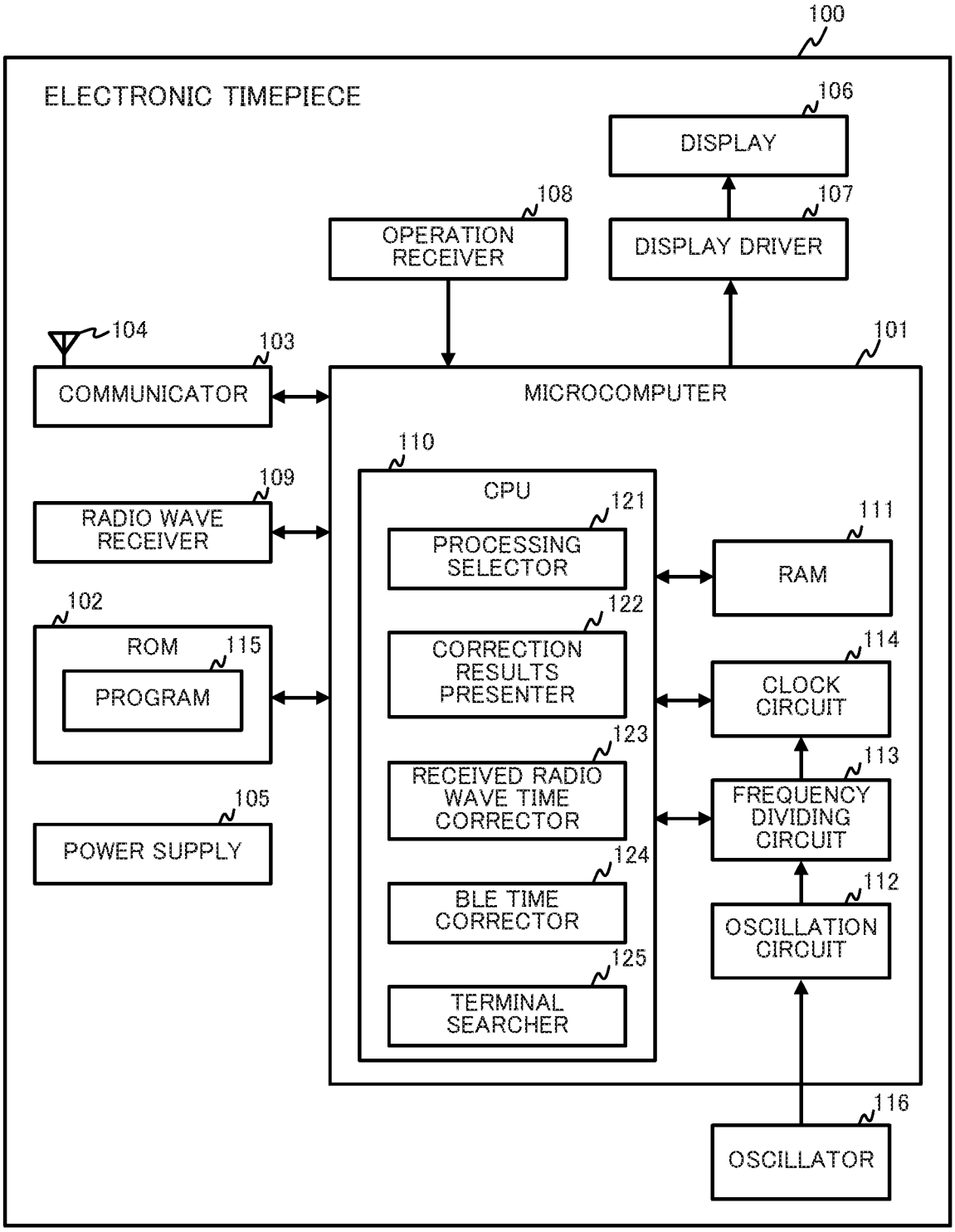
FIG. 2 is a block diagram illustrating a configuration of an electronic timepiece according to Embodiment 1.

First, the hardware configuration of the electronic timepiece 100 according to the present embodiment will be described. FIG. 2 is a block diagram illustrating the configuration of the electronic timepiece 100 according to Embodiment 1. The electronic timepiece 100 includes a microcomputer 101, read-only memory (ROM) 102, a communicator (receiver and transmitter) 103, an antenna 104, a power supply 105, a display 106, a display driver 107, an operation receiver 108, and a radio wave receiver 109.

The microcomputer 101 includes a central processing unit (CPU) 110 as a control unit, random access memory (RAM) 111 as a storage unit, an oscillation circuit 112, a frequency dividing circuit 113, a clock circuit 114, and the like. Note that the RAM 111, the oscillation circuit 112, the frequency dividing circuit 113, and the clock circuit 114 are not limited to being provided in the microcomputer 101 and may be provided outside the microcomputer 101. Additionally, the ROM 102, the communicator 103, the antenna 104, the power supply 105, the display driver 107, and the radio wave receiver 109 are not limited to being provided outside the microcomputer 101 and may be provided in the microcomputer 101.

The CPU 110 is a processor that carries out various types of arithmetic processing and overall control of all operations of the electronic timepiece 100. The CPU 110 reads a control program from the ROM 102 and loads the control program into the RAM 111 to carry out various types of operation processing, such as arithmetic controlling and displaying related to various types of functions. Additionally, the CPU 110 controls the communicator 103 to carry out data communication with the wireless communication device 300.

The RAM 111 is volatile memory such as static random access memory (SRAM) or dynamic random access memory (DRAM). Temporary data and various types of setting data are stored in the RAM 111.

The oscillation circuit 112 causes an oscillator 116 to oscillate, thereby generating and outputting a predetermined frequency signal (clock signal).

The frequency dividing circuit 113 divides the frequency signal input from the oscillation circuit 112 into signals of frequencies to be used by the clock circuit 114 and the CPU 110, and outputs these signals. The frequencies of the output signals may be changed on the basis of settings set by the CPU 110.

The clock circuit 114 clocks the current time by counting the number of times signals are input from the frequency dividing circuit 113, and adding this number to an initial value. The clock circuit 114 may be configured from software that changes a value stored in the RAM 111, or may be configured from dedicated hardware. The time clocked by the clock circuit 114 may be any of cumulative time from a predetermined timing, coordinated universal time (UTC), the time of a preset city (local time), or the like. Additionally, the time clocked by the clock circuit 114 need not be in a date, hour, minute, second format. Moreover, as described later, the time clocked by the clock circuit 114 is corrected on the basis of a command from the CPU 110.

The timer that clocks the current time includes the oscillation circuit 112, the frequency dividing circuit 113, and the clock circuit 114.

The ROM 102 is nonvolatile memory or the like. Control programs, initial setting data, and the like are stored in the ROM 102. The control programs include a program 115 related to the control of the various types of processing (described later).

In one example, the communicator 103 includes a radio frequency (RF) circuit and/or a baseband (BB) circuit, and a memory circuit. The communicator 103 sends and receives radio signals based on BLE via the antenna 104. Additionally, the communicator 103 demodulates and/or decrypts the radio signals received via the antenna 104 and sends these radio signals to the CPU 110. Moreover, the communicator 103 encrypts and/or modulates signals sent from the CPU 110 and sends these signals out via the antenna 104.

In one example, the power supply 105 includes a battery and a voltage conversion circuit. The power supply 105 supplies power at the operating voltage of the components in the electronic timepiece 100. Examples of the battery of the power supply 105 include a primary battery such as a button type dry battery and a secondary battery such as a lithium ion battery.

In one example, the display 106 includes a display panel such as a liquid crystal display (LCD) or an organic electroluminescent (EL) display. The display driver 107 outputs, to the display 106, a driving signal corresponding to the type of display 106 on the basis of a control signal from the microcomputer 101, and displays various types of information on the display panel. Alternatively, the display 106 may have an analog configuration that displays by causing a plurality of hands, including the second hand 15 illustrated in FIGS. 3A to 3D, to rotate via a wheel train mechanism by a stepping motor. In one example, the display 106 displays the current time clocked by the clock circuit 114.

The operation receiver 108 receives input operations from the user and outputs electronic signals corresponding to the input operations to the microcomputer 101 as input signals. In the present embodiment, as illustrated in FIGS. 3A to 3D, the operation receiver 108 includes push button switches 11 to 13 and a timepiece stem 14. The push button switches 11 to 13 output ON signals to the microcomputer 101 as a result of being pressed by the user, and output OFF signals to the microcomputer 101 as a result of being released. Alternatively, a configuration is possible in which the operation receiver 108 is provided by laminating a touch sensor on a display screen of the display 106, thereby providing both a display screen and a touch panel. In this case, the touch sensor detects a contact position and/or a contact mode according to a contact operation by the user on the touch sensor, and outputs an operation signal corresponding to the detected contact position and/or contact mode to the CPU 110.

The radio wave receiver 109 receives the standard radio waves for clock correction from the radio tower 200 and outputs time information, transmitted by the received standard radio waves, to the CPU 110.

Next, the functional configuration of the CPU 110 of the electronic timepiece 100 according to the present embodiment will be described. As illustrated in FIG. 2, the CPU 110 functions as a processing selector 121, a correction results presenter 122, a received radio wave time corrector 123, a BLE time corrector 124, and a terminal searcher 125. Note that the functions of the processing selector 121, the correction results presenter 122, the received radio wave time corrector 123, the BLE time corrector 124, and the terminal searcher 125 may be realized by a processor other than the microcomputer 101. For example, these functions may be realized by the CPU of the communicator 103.

The CPU 110 as the processing selector 121 selects, in accordance with an operation received from the operation receiver 108, one of received radio wave time correction processing (first processing) to correct the current time clocked by the clock circuit 114 on the basis of the standard radio waves received from the radio wave receiver 109, and at least one second processing that differs from the first processing. In the present embodiment, an example is described in which the second processing is three types of processing (described later), namely correction result presentation processing, BLE time correction processing, and terminal search processing.

Specifically, in accordance with the duration of the ON operation received from the push button switch 12 of the operation receiver 108, the CPU 110 selects one of the received radio wave time correction processing, the correction result presentation processing, the BLE time correction processing, and the terminal search processing. In one example, the CPU 110 selects the correction result presentation processing when the ON signal is received as a result of the user pressing the push button switch 12. In the present embodiment, when the ON signal is received, the CPU 110 causes the second hand 15 to rotate from the base state illustrated in FIG. 3A, and stops the second hand 15 so as to point at the "Y" or "N" icon that represents the results of the correction result presentation processing, as illustrated in FIG. 3B.

Figure 3A:
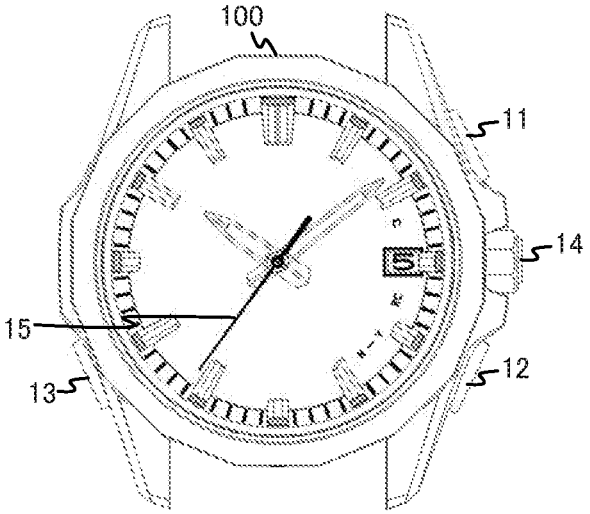
FIG. 3A is a drawing illustrating a position of the second hand corresponding to processing executed by the CPU of the electronic timepiece.
Figure 3B:
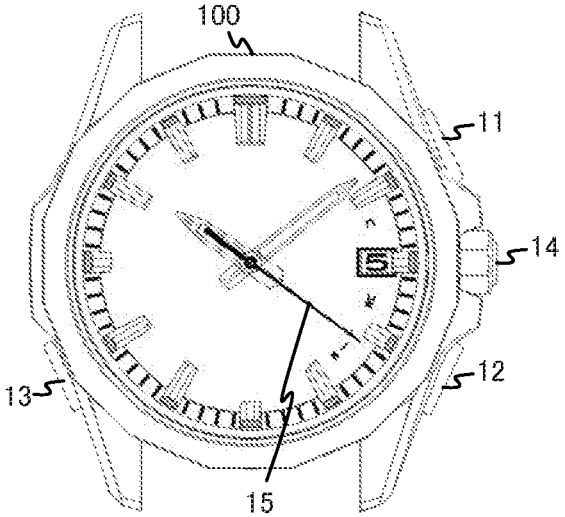
FIG. 3B is a drawing illustrating a position of the second hand corresponding to processing executed by the CPU of the electronic timepiece.
Figure 3C:
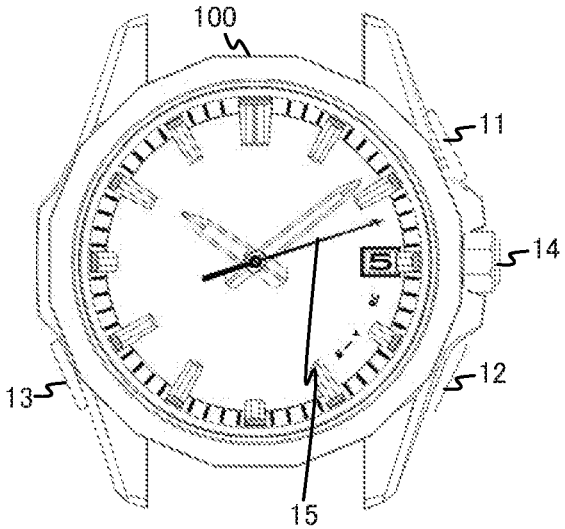
FIG. 3C is a drawing illustrating a position of the second hand corresponding to processing executed by the CPU of the electronic timepiece.

Furthermore, when the duration t of the ON signal is such that 0.5 s≤t, the CPU 110 causes the second hand 15 to rotate from the position illustrated in FIG. 3B and to stop so as to point at the "C" icon that corresponds to the BLE time correction processing, as illustrated in FIG. 3C. Moreover, the CPU 110 selects the BLE time correction processing when it is possible to receive the standard radio waves and the OFF signal is received from the push button switch 12 for the duration t where 0.5 s≤t<1.5 s, or when it is not possible to receive the standard radio waves and an OFF signal is received from the push button switch 12 for the duration t where 0.5 s≤t<3.5 s.

Figure 3D:
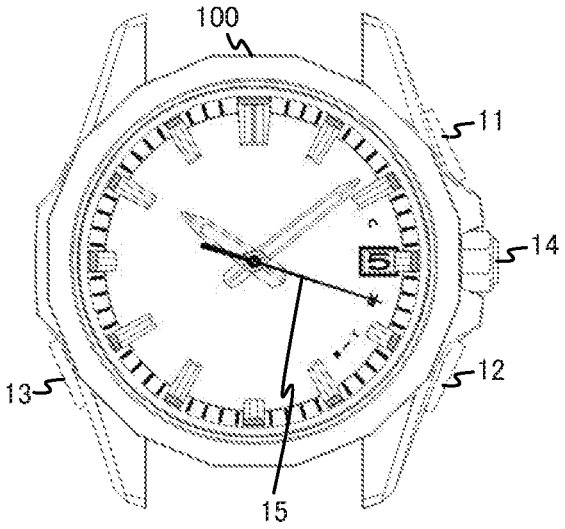
FIG. 3D is a drawing illustrating a position of the second hand corresponding to processing executed by the CPU of the electronic timepiece.

Furthermore, when it is possible to receive the standard radio waves and the duration t is such that 1.5 s≤t, the CPU 110 causes the second hand 15 to rotate from the position illustrated in FIG. 3C and to stop so as to point at the "RC" icon that corresponds to the received radio wave time correction processing, as illustrated in FIG. 3D. Moreover, the CPU 110 selects the received radio wave time correction processing when the OFF signal is received from the push button switch 12 for the duration t where 1.5 s≤t<2.5 s.

Furthermore, when it is possible to receive the standard radio waves and the duration t is such that 2.5 s≤t, the CPU 110 causes the second hand 15 to rotate from the position illustrated in FIG. 3D and to stop so as to point at the "C" icon that corresponds to the terminal search processing, as illustrated in FIG. 3C. Additionally, when it is not possible to receive the standard radio waves and the duration t is such that 3.5 s≤t, the CPU 110 causes the second hand 15 to rotate one rotation from the position illustrated in FIG. 3C and to stop so as to point again at the "C" icon that corresponds to the terminal search processing, as illustrated in FIG. 3C. Then, the CPU 110 selects the terminal search processing. Note that, the timings at which the second hand is caused to rotate in accordance with the duration that the ON signal was received are not limited to the examples described above and any timing may be used.

Next, a determination method whereby the CPU 110 as the processing selector 121 determines whether the standard radio waves can be received will be described. In the present embodiment, the CPU 110 controls the communicator 103 to receive, in advance from the wireless communication device 300, radio station information related to a radio station sending the standard radio waves, and determines, on the basis of the received radio station information, whether the standard radio waves can be received by the radio wave receiver 109. Note that, a configuration is possible in which the ROM 102 of the electronic timepiece 100 maintains correspondence information indicating correspondence relationships between time zones and areas where it is possible to receive the standard radio waves, and the CPU 110 determines whether the standard radio waves can be received on the basis of the time zone set by the user and by referencing the correspondence information.

When the correction result presentation processing is selected by the processing selector 121, the CPU 110 as the correction results presenter 122 executes the correction result presentation processing. The correction result presentation processing is processing for presenting, to the user, whether the previously executed time correction was successful. In the present embodiment, when the processing selector 121 selects the correction result presentation processing and the previously executed time correction was successful, the CPU 110 controls the rotation of the second hand 15 so that the second hand 15 points at the "Y." Alternatively, when the previously executed time correction was unsuccessful, the CPU 110 controls the rotation of the second hand 15 so that the second hand 15 points at the "N." Moreover, when the OFF signal is received in a case where the duration t of the ON signal was such that 0 s<t<0.5 s, the CPU 110 controls the rotation of the second hand 15 so as to return the second hand 15 to the base state illustrated in FIG. 3A after the passage of a predetermined amount of time (for example, 10 seconds) from when the OFF signal was received.

When the received radio wave time correction processing is selected by the processing selector 121, the CPU 110 as the received radio wave time corrector 123 executes the received radio wave time correction processing. In the present embodiment when the received radio wave time correction processing is selected by the processing selector 121, the CPU 110 starts the reception of the standard radio waves by the radio wave receiver 109. Then, the CPU 110 corrects the current time, clocked by the clock circuit 114, on the basis of the time information transmitted by the received radio waves. Then, after the received radio wave time correction processing has ended, the CPU 110 controls the rotation of the second hand 15 so as to return the second hand 15 to the base state illustrated in FIG. 3A.

When the BLE time correction processing is selected by the processing selector 121, the CPU 110 as the BLE time corrector 124 executes the BLE time correction processing. In the present embodiment, the CPU 110 controls the communicator 103 to send an advertising packet and establish a connection with the wireless communication device 300 that received the advertising packet. Then, the CPU 110 acquires the time information from the connected wireless communication device 300 and corrects the current time, clocked by the clock circuit 114, on the basis of the acquired time information. Then, after the BLE time correction processing has ended, the CPU 110 controls the rotation of the second hand 15 so as to return the second hand 15 to the base state illustrated in FIG. 3A.

When the execution of the terminal search processing is selected by the processing selector 121, the CPU 110 as the terminal searcher 125 establishes a BLE connection with the wireless communication device 300. Then, the CPU 110 issues a command to ring the wireless communication device 300 so that the user can discover the wireless communication device 300.

Figure 4:
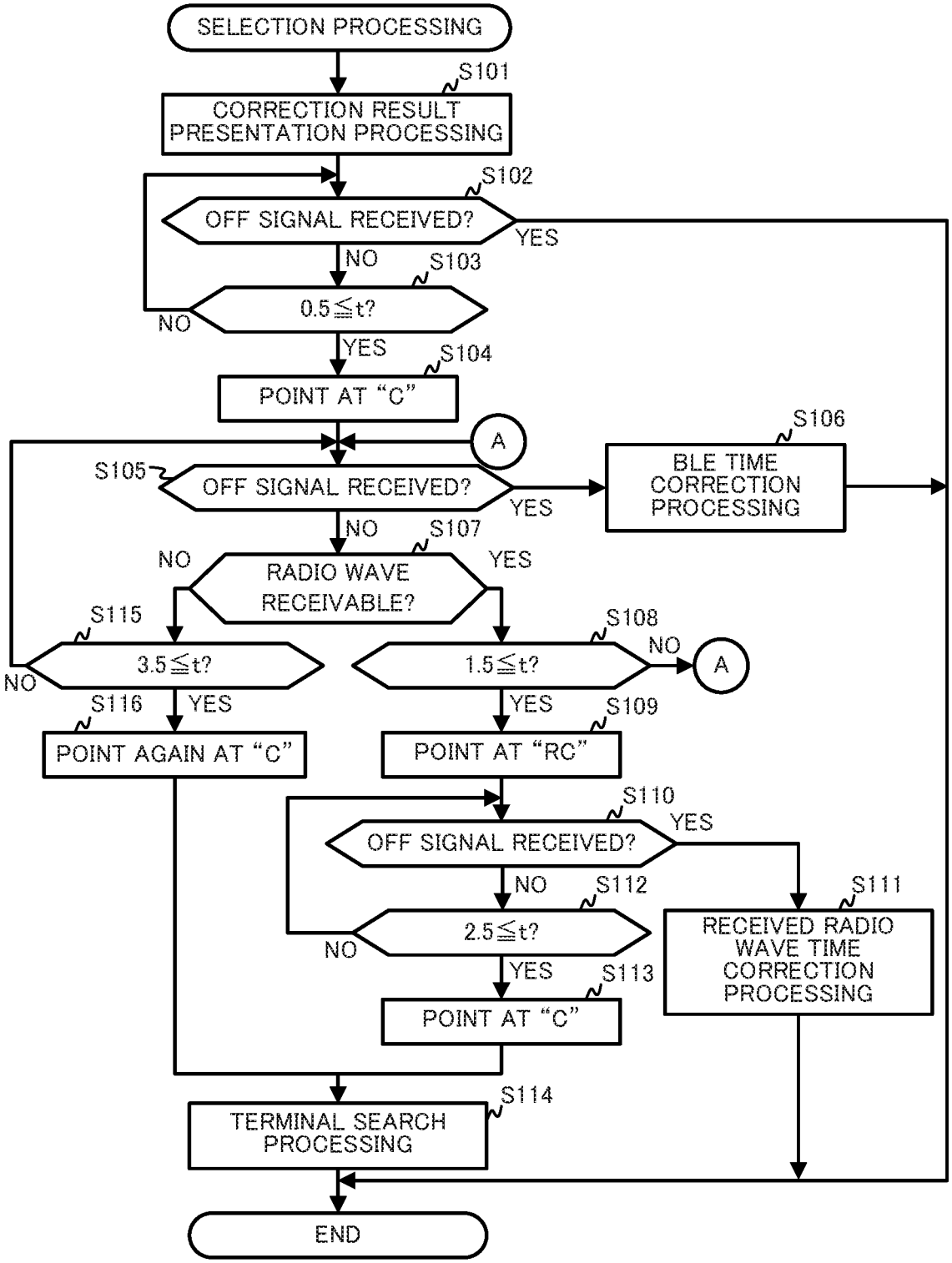
FIG. 4 is a flowchart illustrating an example of the flow of selection processing, executed by the CPU of the electronic timepiece, according to Embodiment 1.

Next, the operations of the electronic timepiece 100 according to the present embodiment will be described. FIG. 4 is a flowchart illustrating an example of the flow of the selection processing, executed by the CPU 110 of the electronic timepiece 100, according to the present embodiment. In the example illustrated in FIG. 4, the CPU 110 starts the selection processing upon the reception of the ON signal from the push button switch 12 of the operation receiver 108. Note that the second hand 15 is positioned in the base state illustrated in FIG. 3A at the starting point of this processing.

First, the CPU 110 executes the correction result presentation processing (step S101). Then, the CPU 110 determines whether the OFF signal has been received from the push button switch 12 of the operation receiver 108 (step S102). When it is determined that the OFF signal has been received from the operation receiver 108 (step S102; Yes), the CPU 110 ends the processing.

When it is determined that the OFF signal has not been received from the operation receiver 108 (step S102; No), the CPU 110 determines whether the duration t of the ON signal from the push button switch 12 is 0.5 s or longer (step S103). When it is determined that the duration t is not 0.5 s or longer (step S103; No), the CPU 110 returns to the processing of step S102.

When it is determined that the duration t is 0.5 s or longer (step S103; Yes), the CPU 110 controls the rotation of the second hand 15 so that the second hand 15 points at the "C" (step S104). Thereafter, the CPU 110 determines whether the OFF signal has been received from the push button switch 12 of the operation receiver 108 (step S105). When it is determined that the OFF signal has been received from the push button switch 12 of the operation receiver 108 (step S105; Yes), the CPU 110 executes the BLE time correction processing (step S106) and then ends the processing.

When it is determined that the OFF signal has not been received from the push button switch 12 of the operation receiver 108 (step S107; No), the CPU 110 determines whether the electronic timepiece 100 can receive the standard radio waves (step S107).

When it is determined that the electronic timepiece 100 can receive the standard radio waves (step S107; Yes), the CPU 110 determines whether the duration t is 1.5 s or longer (step S108). When it is determined that the duration t is not 1.5 s or longer (step S108; No), the CPU 110 returns to the processing of step S105.

When it is determined that the duration t is 1.5 s or longer (step S108; Yes), the CPU 110 controls the rotation of the second hand 15 so that the second hand 15 points at the "RC" (step S109). Thereafter, the CPU 110 determines whether the OFF signal has been received from the push button switch 12 of the operation receiver 108 (step S110). When it is determined that the OFF signal has been received from the push button switch 12 of the operation receiver 108 (step S110; Yes), the CPU 110 executes the received radio wave time correction processing (step S111) and then ends the processing.

When it is determined that the OFF signal has not been received from the push button switch 12 of the operation receiver 108 (step S110; No), the CPU 110 determines whether the duration t is 2.5 s or longer (step S112). When it is determined that the duration t is not 2.5 s or longer (step S112; No), the CPU 110 returns to the processing of step S110.

When it is determined that the duration t is 2.5 s or longer (step S112; Yes), the CPU 110 controls the rotation of the second hand 15 so that the second hand 15 points at the "C" (step S113). Thereafter, the CPU 110 executes the terminal search processing (step S114). Then, the CPU 110 ends the processing.

However, when it is determined that the electronic timepiece 100 cannot receive the standard radio waves (step S107; No), the CPU 110 determines whether the duration t is 3.5 s or longer (step S115). When it is determined that the duration t is not 3.5 s or longer (step S115; No), the CPU 110 returns to the processing of step S105.

When it is determined that the duration t is 3.5 s or longer (step S115; Yes), the CPU 110 controls the rotation of the second hand 15 so that the second hand 15 again points at the "C" (step S116). Thereafter, the CPU 110 executes the terminal search processing (step S114). Then, the CPU 110 ends the processing.

As described above, when the CPU 110 of the electronic timepiece 100 according to the present embodiment cannot receive the standard radio waves in accordance with an operation received by the operation receiver 108, the execution of the other processing is selected in accordance with the operation received by the operation receiver 108, without selecting the received radio wave time correction processing. Accordingly, situations will not occur in which the received radio wave time correction processing can be selected regardless of it not being possible to receive the standard radio waves and, as such, the operability of the electronic timepiece 100 can be improved. Additionally, state transition to the received radio wave time correction processing does not occur when the standard radio waves cannot be received and, as such, the power consumption of the electronic timepiece 100 can be reduced.

Additionally, in accordance with the duration of the ON signal received from the push button switch 12 of the operation receiver 108, the CPU 110 selects and executes one of the received radio wave time correction processing, the correction result presentation processing, the BLE time correction processing, and the terminal search processing. Accordingly, it is possible to select, with a single button, processing to be executed from among a plurality of processings.

Additionally, in accordance with the operation received from the operation receiver 108, the CPU 110 controls the rotation of the second hand 15 so as to stop at the position corresponding to each of the received radio wave time correction processing, the correction result presentation processing, the BLE time correction processing, and the terminal search processing. Accordingly, the user can easily recognize which processing can be selected by the position of the second hand 15.

Furthermore, when the standard radio waves cannot be received by the radio wave receiver 109, the CPU 110 controls the rotation of the second hand 15 so as to stop at the position corresponding to the received radio wave time correction processing. Accordingly, the user can easily recognize whether the standard radio waves can be received by the rotation of the second hand 15.

Additionally, as the second processing, the CPU 110 controls the communicator 103 and executes the BLE time correction processing to correct the current time, clocked by the clock circuit 114, on the basis of the time information received from the wireless communication device 300. Accordingly, when the standard radio waves can be received, time correction can be executed by selecting the received radio wave time correction processing or the BLE time correction processing according to the operation received by the operation receiver 108 and, when the standard radio waves cannot be received, time correction can be executed by selecting the BLE time correction processing.

Embodiment 2

In Embodiment 1, an example was described in which three types of processing, namely the correction result presentation processing, the BLE time correction processing, and the terminal search processing were selectively executed as the second processing. However, the content of the processing executed as the second processing and the number of the second processing are not limited thereto. Hereinafter, in Embodiment 2, an example is described in which the second processing further includes data communication processing with the wireless communication device 300. Note that, in Embodiment 2, components that are the same as in Embodiment 1 are marked with the same reference numerals, and descriptions thereof are forgone.

Figure 5:
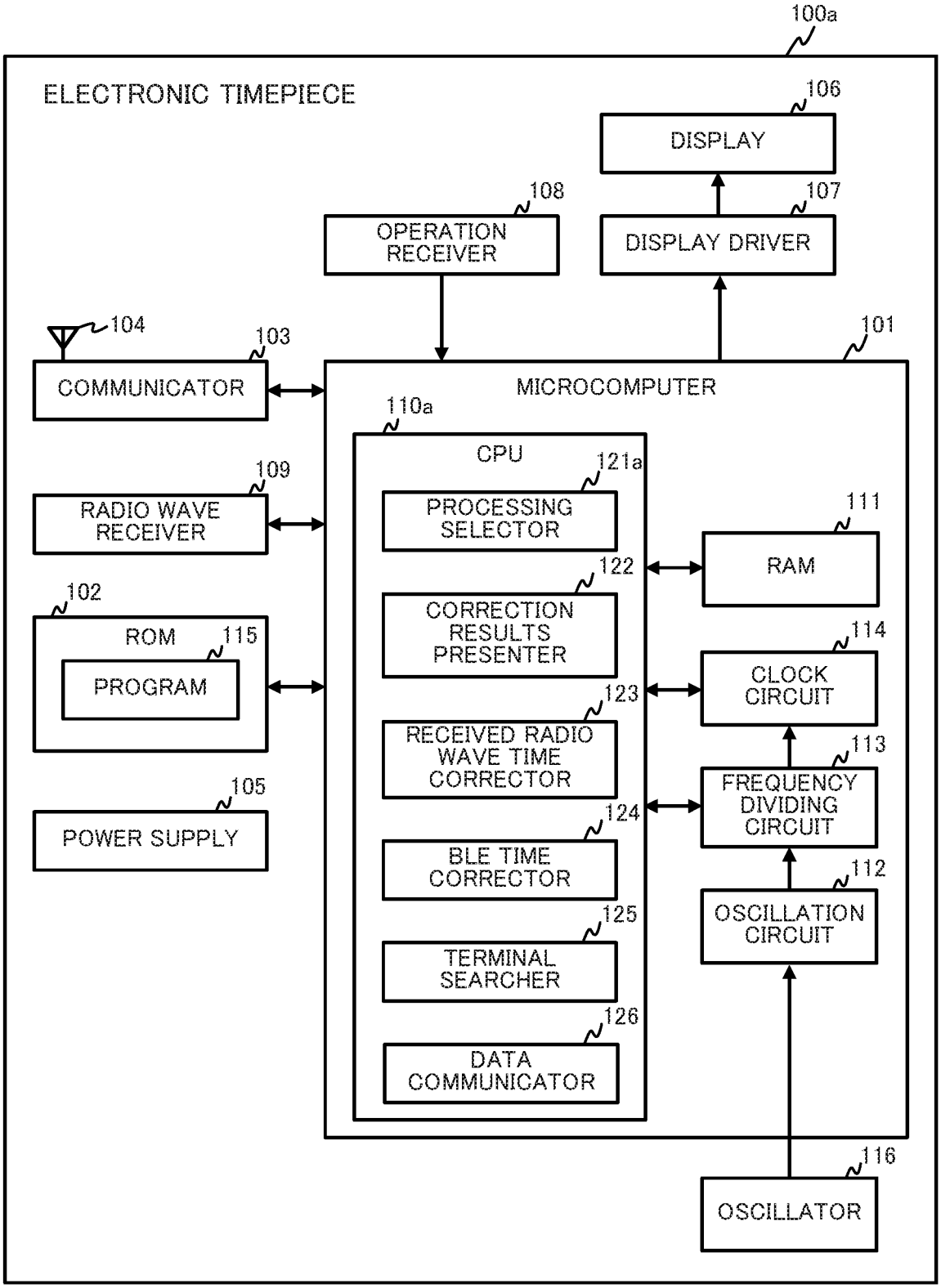
FIG. 5 is a block diagram illustrating a configuration of an electronic timepiece according to Embodiment 2.

FIG. 5 is a block diagram illustrating the configuration of an electronic timepiece 100*a* according to Embodiment 2. As illustrated in FIG. 5, a CPU 110*a* of the electronic timepiece 100*a* functions as a processing selector 121*a* instead of as the processing selector 121 of Embodiment 1 illustrated in FIG. 2, and also functions as a data communicator 126.

The CPU 110*a* as the processing selector 121*a* selects, in accordance with an operation received from the operation receiver 108, one of received radio wave time correction processing (first processing) to correct the current time clocked by the clock circuit 114 on the basis of the standard radio waves received from the radio wave receiver 109, and at least one second processing that differs from the first processing. In Embodiment 2, the second processing includes data communication processing in addition to the three types of processing described in Embodiment 1, namely the correction result presentation processing, the BLE time correction processing, and the terminal search processing.

Specifically, in accordance with the duration of the ON operation received from the push button switch 12 of the operation receiver 108, the CPU 110*a* selects one of the received radio wave time correction processing, the correction result presentation processing, the BLE time correction processing, the terminal search processing, and the data communication processing. In one example, as described in Embodiment 1, the CPU 110*a* selects the correction result presentation processing when the ON signal is received as a result of the user pressing the push button switch 12.

Furthermore, when the duration t of the ON signal is such that 0.5 s≤t, the CPU 110*a* causes the second hand 15 to rotate from the position illustrated in FIG. 3B and to stop so as to point at the "C" icon that corresponds to the BLE time correction processing, as illustrated in FIG. 3C. Moreover, the CPU 110*a* selects the BLE time correction processing when it is possible to receive the standard radio waves and the OFF signal is received from the push button switch 12 for the duration t where 0.5 s≤t<1.5 s, or when it is not possible to receive the standard radio waves and an OFF signal is received from the push button switch 12 for the duration t where 0.5 s≤t<4.0 s.

Furthermore, when it is possible to receive the standard radio waves and the duration t is such that 1.5 s≤t, the CPU 110*a* causes the second hand 15 to rotate from the position illustrated in FIG. 3C and to stop so as to point at the "RC" icon that corresponds to the received radio wave time correction processing, as illustrated in FIG. 3D. Moreover, the CPU 110*a* selects the received radio wave time correction processing when the OFF signal is received from the push button switch 12 for the duration t where 1.5 s≤t<4.0 s.

Furthermore, when it is possible to receive the standard radio waves and the duration t is such that 4.0 s≤t, the CPU 110*a* causes the second hand 15 to rotate from the position illustrated in FIG. 3D and to stop so as to point at the "C" icon that corresponds to the data communication processing, as illustrated in FIG. 3C. Additionally, when it is not possible to receive the standard radio waves and the duration t is such that 4.0 s≤t, the CPU 110*a* causes the second hand 15 to rotate one rotation from the position illustrated in FIG. 3C and to stop so as to point again at the "C" icon that corresponds to the data communication processing, as illustrated in FIG. 3C. Moreover, the CPU 110*a* selects the data communication processing when the OFF signal is received from the push button switch 12 for the duration t where 4.0 s≤t<6.0 s.

Furthermore, when the duration t is such that 6.0 s≤t, the CPU 110*a* causes the second hand 15 to rotate one rotation from the position illustrated in FIG. 3C and to stop so as to point again at the "C" icon that corresponds to the terminal search processing, as illustrated in FIG. 3C. Then, the CPU 110*a* selects the terminal search processing. Note that, the timings at which the second hand is caused to rotate in accordance with the duration that the ON signal was received are not limited to the examples described above and any timing may be used.

When the execution of the data communication processing is selected by processing selector 121*a*, the CPU 110*a* as the data communicator 126 establishes a BLE connection with the wireless communication device 300. Then, the CPU 110*a* carries out data communication with the wireless communication device 300 in accordance with commands of a preset application or the like. In one example, in the data communication processing, the electronic timepiece 100*a* sends data, such as temperature and humidity measured by the device itself, to the wireless communication device 300.

Figure 6:
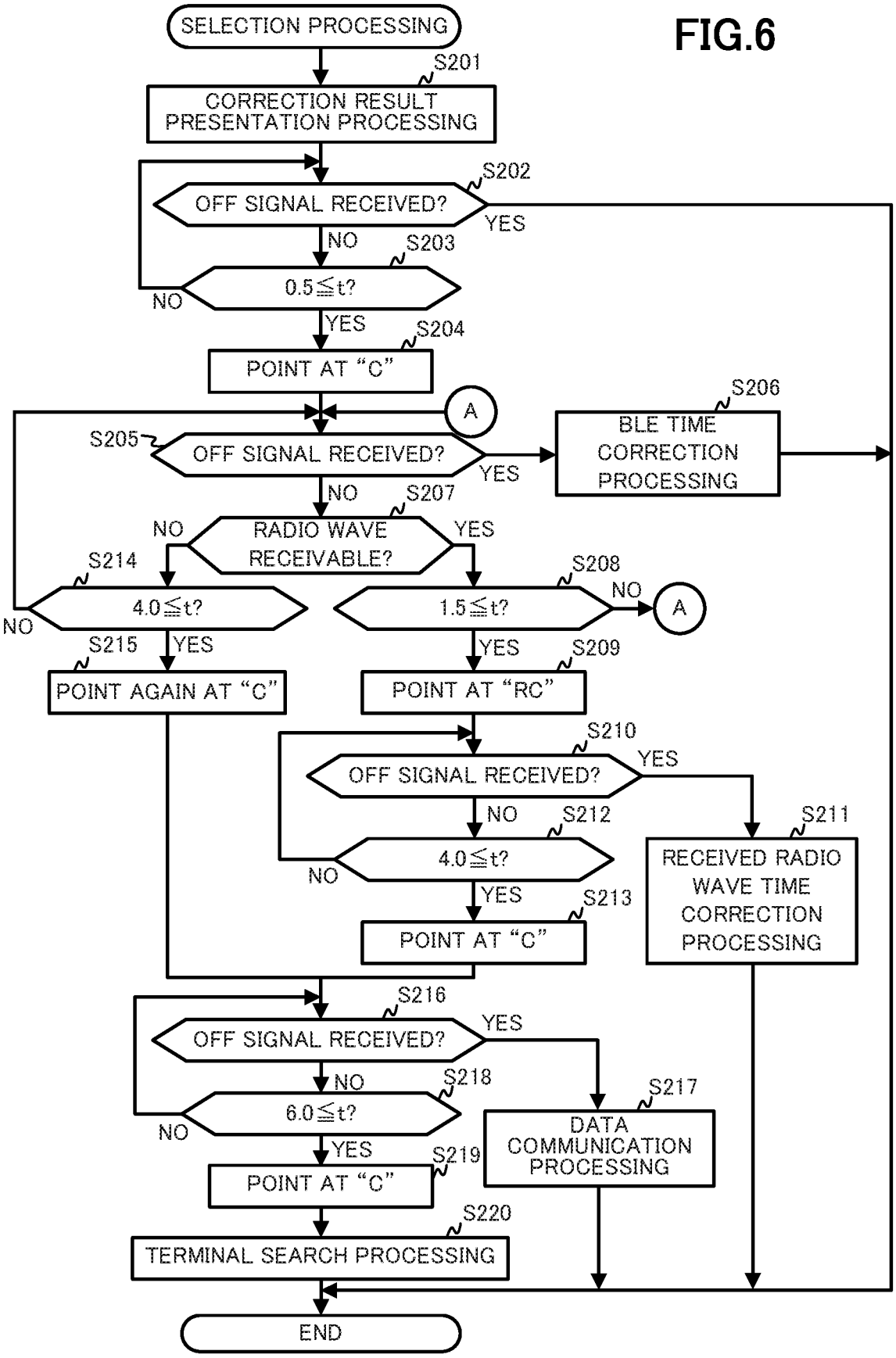
FIG. 6 is a flowchart illustrating an example of the flow of selection processing, executed by the CPU of the electronic timepiece, according to Embodiment 2.

Next, the operations of the electronic timepiece 100*a* according to the present embodiment will be described. FIG. 6 is a flowchart illustrating an example of the flow of the selection processing, executed by the CPU 110*a* of the electronic timepiece 100*a*, according to the present embodiment. In the example illustrated in FIG. 6, the CPU 110*a* starts the selection processing upon the reception of the ON signal from the push button switch 12 of the operation receiver 108. Note that the second hand 15 is positioned in the base state illustrated in FIG. 3A at the starting point of this processing.

In steps S201 to S211, the CPU 110*a* executes the same processing as in steps S101 to S111 of Embodiment 1 illustrated in FIG. 4.

When it is determined that the OFF signal has not been received from the push button switch 12 of the operation receiver 108 (step S210; No), the CPU 110*a* determines whether the duration t is 4.0 s or longer (step S212). When it is determined that the duration t is not 4.0 s or longer (step S212; No), the CPU 110*a* returns to the processing of step S210. Alternatively, when it is determined that the duration t is 4.0 s or longer (step S212; Yes), the CPU 110*a* controls the rotation of the second hand 15 so that the second hand 15 points at the "C" (step S213).

However, when it is determined that the electronic timepiece 100*a* cannot receive the standard radio waves (step S207; No), the CPU 110*a* determines whether the duration t is 4.0 s or longer (step S214). When it is determined that the duration t is not 4.0 s or longer (step S214; No), the CPU 110*a* returns to the processing of step S205. Alternatively, when it is determined that the duration t is 4.0 s or longer (step S214; Yes), the CPU 110*a* controls the rotation of the second hand 15 so that the second hand 15 points again at the "C" (step S215).

Thereafter, the CPU 110*a* determines whether the OFF signal has been received from the push button switch 12 of the operation receiver 108 (step S216). When it is determined that the OFF signal has been received from the push button switch 12 of the operation receiver 108 (step S216; Yes), the CPU 110*a* executes the data communication processing (step S217) and then ends the processing.

When it is determined that the OFF signal has not been received from the push button switch 12 of the operation receiver 108 (step S216; No), the CPU 110*a* determines whether the duration t is 6.0 s or longer (step S218). When it is determined that the duration t is not 6.0 s or longer (step S218; No), the CPU 110*a* returns to the processing of step S216. Alternatively, when it is determined that the duration t is 6.0 s or longer (step S218; Yes), the CPU 110*a* controls the rotation of the second hand 15 so that the second hand 15 points at the "C" (step S219), and executes the terminal search processing (step S220). Then, the CPU 110*a* ends the processing.

As described above, the CPU 110*a* of the electronic timepiece 100*a* according to this embodiment can further select data communication processing with the wireless communication device 300 as the second processing. Accordingly, situations will not occur in which the received radio wave time correction processing can be selected regardless of it not being possible to receive the standard radio waves and, as such, the operability of the electronic timepiece 100 can be improved and also it is possible to select, with a single button, processing to be executed from among a plurality of processings.

Note that, the present disclosure is not limited to the embodiments descried above and various modifications are possible.

For example, in Embodiments 1 and 2, an example is described in which, as the time correction processing, the current time is corrected on the basis of the time information of the standard radio waves and the time information from the wireless communication device 300. However, the time correction method is not limited thereto and, for example, when the time correction processing based on time information received from a GPS satellite is executable, the electronic timepiecees 100 and 100*a* may select this time correction processing as the second processing.

In another example, in the embodiments described above, an example is described in which the electronic timepiecees 100 and 100*a* communicate with the wireless communication device 300 via Bluetooth (registered trademark). However, the electronic timepiecees 100 and 100*a* may communicate with the wireless communication device 300 via a different method such as, for example, via a wireless local area network (LAN) or Wi-Fi (registered trademark).

Additionally, the determination of whether the standard radio waves can be received may be carried out by the CPU 110 performing, in advance, the determination of whether the electronic timepiecees 100 and 100*a* can receive the standard radio waves at the stage prior to the selection processing in the embodiments described above, and acquiring these determination results in steps S107 and S207.

Additionally, in the embodiments described above, an example is described in which the CPU 110 and 110*a* carry out control operations. However, the control operations are not limited to software control by the CPU 110 and 110*a*. Part or all of the control operations may be realized using hardware components such as dedicated logic circuits.

Additionally, in the foregoing description, an example was described in which the ROM 102, made from nonvolatile memory such as flash memory, was used as the computer-readable medium on which the program 115 related to the wireless control processing of the present disclosure was stored. However, the computer-readable medium is not limited thereto, and portable recording media such as hard disk drives (HDD), compact disc read-only memory (CD-ROM), and digital versatile discs (DVD) may be used. Additionally, a carrier wave may be used in the present disclosure as the medium to provide, over a communication line, the data of the program of the present disclosure.

In addition, the specific details such as the configurations, the control procedures, and the display examples described in the embodiments may be appropriately modified without departing from the scope of the present disclosure.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. An electronic timepiece comprising:

a timer configured to clock a current time;

a receiver configured to receive low frequency band standard radio waves;

a communicator configured to wirelessly communicate with a wireless communication device;

a switch configured to receive an operation from a user; and a processor configured to:

determine a duration of the operation from the user received by the switch;

acquire a first determination result indicating whether the low frequency band standard radio waves are receivable by the receiver;

acquire a second determination result indicating whether the duration of the operation is equal to or greater than a first predetermined duration;

acquire a third determination result indicating whether the duration of the operation is equal to or greater than a second predetermined duration, the second predetermined duration being longer than the first predetermined duration; and based on the first determination result, the second determination result and the third determination result, select and execute one of a first processing and at least one second processing that differs from the first processing, wherein the first processing comprises processing to correct the current time clocked by the timer on the basis of the low frequency band standard radio waves received by the receiver, and wherein the at least one second processing comprises processing to correct the current time clocked by the timer on the basis of time information received from the wireless communication device received by the communicator, wherein the processor is configured to:

based on the first determination result indicating that the low frequency band standard radio waves are receivable by the receiver and the second determination result indicating that the duration of the operation is less than the first predetermined duration, select and execute the at least one second processing;

based on the first determination result indicating that the low frequency band standard radio waves are receivable by the receiver and the second determination result indicating that the duration of the operation is equal to or greater than the first predetermined duration, select and execute the first processing; and based on the first determination result indicating that the low frequency band standard radio waves are not receivable by the receiver and the third determination result indicating that the duration of the operation is not equal to or greater than the second predetermined duration, select and execute the second processing.

2. The electronic timepiece according to claim 1, further comprising:

a hand configured to be controlled to rotate, wherein the processor is configured to control the hand to rotate so as to stop, in accordance with the operation from the user received by the switch, at one of positions each corresponding to the respective ones of the first processing and the at least one second processing.

3. The electronic timepiece according to claim 1, further comprising:

a hand configured to be controlled to rotate, wherein the processor is configured to:

control the hand to rotate to stop at a position corresponding to the at least one second processing;

based on the first determination result indicating that the low frequency band standard radio waves are receivable by the receiver and the second determination result indicating that the duration of the operation is less than the predetermined duration, control the hand to remain at the position corresponding to the at least one second processing, and select and execute the least one second processing; and based on the first determination result indicating that the low frequency band standard radio waves are receivable by the receiver and the second determination result indicating that the duration of the operation is equal to or greater than the predetermined duration, control the hand to rotate so as not to stop at a position corresponding to the first processing, and select and execute the first processing.

4. The electronic timepiece according to claim 1, wherein the processor is configured to:

control the communicator to receive, from the wireless communication device, radio station information related to a radio station that sends the low frequency standard radio waves; and acquire, on the basis of the radio station information received, the first determination result indicating whether the low frequency band standard radio waves are receivable by the receiver.

5. A processing selection method to be executed by an electronic timepiece comprising a timer configured to clock a current time, a receiver configured to receive low frequency band standard radio waves, a communicator configured to wirelessly communicate with a wireless communication device, and a switch configured to receive an operation from a user, wherein the processing selection method comprises:

determining a duration of the operation from the user received by the switch;

acquiring a first determination result indicating whether the low frequency band standard radio waves are receivable by the receiver;

acquiring a second determination result indicating whether the duration of the operation is equal to or greater than a first predetermined duration;

acquiring a third determination result indicating whether the duration of the operation is equal to or greater than a second predetermined duration, the second predetermined duration being longer than the first predetermined duration; and based on the first determination result, the second determination result and the third determination result, selecting and executing one of a first processing and at least one second processing that differs from the first processing, wherein the first processing comprises processing to correct the current time clocked by the timer on the basis of the low frequency band standard radio waves received by the receiver, and wherein the at least one second processing comprises processing to correct the current time clocked by the timer on the basis of time information received from the wireless communication device received by the communicator;

wherein, based on the first determination result indicating that the low frequency band standard radio waves are receivable by the receiver and the second determination result indicating that the duration of the operation is less than the first predetermined duration, the at least one second processing is selected and executed, wherein, based on the first determination result indicating that the low frequency band standard radio waves are receivable by the receiver and the second determination result indicating that the duration of the operation is equal to or greater than the first predetermined duration, the first processing is selected and executed, and wherein, based on the first determination result indicating that the low frequency band standard radio waves are not receivable by the receiver and the third determination result indicating that the duration of the operation is not equal to or greater than the second predetermined duration, the second processing is selected and executed.

6. A non-transitory computer-readable storage medium storing a program for controlling an electronic timepiece comprising a timer configured to clock a current time, a receiver configured to receive low frequency band standard radio waves, a communicator configured to wirelessly communicate with a wireless communication device, and a switch configured to receive an operation from a user, wherein the program causes a computer to at least perform:

determine a duration of the operation from the user received by the switch;

acquire a first determination result indicating whether the low frequency band standard radio waves are receivable by the receiver;

acquire a second determination result indicating whether the duration of the operation is equal to or greater than a first predetermined duration;

acquire a third determination result indicating whether the duration of the operation is equal to or greater than a second predetermined duration, the second predetermined duration being longer than the first predetermined duration; and based on the first determination result, the second determination result and the third determination result, select and execute one of a first processing and at least one second processing that differs from the first processing, wherein the first processing comprises processing to correct the current time clocked by the timer on the basis of the low frequency band standard radio waves received by the receiver, and wherein the at least one second processing comprises processing to correct the current time clocked by the timer on the basis of time information received from the wireless communication device received by the communicator;

wherein the program causes the processor to:

based on the first determination result indicating that the low frequency band standard radio waves are receivable by the receiver and the second determination result indicating that the duration of the operation is less than the first predetermined duration, select and execute the at least one second processing;

based on the first determination result indicating that the low frequency band standard radio waves are receivable by the receiver and the second determination result indicating that the duration of the operation is equal to or greater than the first predetermined duration, select and execute the first processing; and based on the first determination result indicating that the low frequency band standard radio waves are not receivable by the receiver and the third determination result indicating that the duration of the operation is not equal to or greater than the second predetermined duration, select and execute the second processing.

* * * * *